US006082539A

United States Patent [19]

Lee

[11] Patent Number: 6,082,539

[45] Date of Patent: Jul. 4, 2000

[54] LOCKING DEVICE OF A TOOL BOX

[76] Inventor: Pei-Ling Lee, 11F-2, No. 43, Chia-I Street., Taichung City, Taiwan

[21] Appl. No.: 09/226,269

[22] Filed: Jan. 7, 1999

[51] Int. Cl.[7] ..... B65D 85/28

[52] U.S. Cl. ..... 206/373; 206/1.5; 206/821; 220/326; 220/23.83

[58] Field of Search ..... 206/372, 373, 206/349, 503, 1.5, 821, 378; 220/326, 324, 23.83, 4.26

[56] References Cited

U.S. PATENT DOCUMENTS

| | | | |
|---|---|---|---|
| 491,865 | 2/1893 | Wynn | 220/326 |
| 2,750,064 | 6/1956 | Clarke | 220/324 |
| 2,792,245 | 5/1957 | Dasher | 220/326 |
| 3,811,559 | 5/1974 | Carter | 220/23.6 |
| 4,619,363 | 10/1986 | Wolfseder | 206/373 |
| 5,011,013 | 4/1991 | Meisner et al. | 206/373 |
| 5,145,064 | 9/1992 | Chen | 206/372 |
| 5,385,257 | 1/1995 | Hung | 220/324 |
| 5,603,402 | 2/1997 | Cuneo | 206/320 |

*Primary Examiner*—Paul T. Sewell
*Assistant Examiner*—Nhan T. Lam
*Attorney, Agent, or Firm*—Charles E Baxley, Esq.

[57] ABSTRACT

A tool box includes a base portion with a first recess and a cover with a second recess wherein a locking member is pivotally engaged with the first recess. The locking member has an engaging device. A first rib and a second rib respectively extend from the bottom of the first recess and the second recess so that the engaging device of the locking member is engaged with the second rib to connect the base portion and the cover. When two tool boxes are overlapped, the engaging device of the locking member of the lower tool box can be engaged with the first rib of the upper tool box so as to secure the two overlapped tool boxes.

4 Claims, 5 Drawing Sheets

LOCKING DEVICE OF A TOOL BOX

FIELD OF THE INVENTION

The present invention relates to a locking device, and more particularly, to an improved locking device of a tool box wherein the locking member is pivotally connected to the base portion of the tool box and the each of the cover and the base portion has an engaging member so that when overlapping the tool boxes, the locking member of the lower tool box can engage with the engaging member of the upper tool box.

BACKGROUND OF THE INVENTION

A conventional locking device for a tool box is integrally connected to the base portion 1 of the tool box by way of plastic mold injection or plastic blowing so that there will have a surplus portion 12 attached to the periphery of the base portion and another surplus portion 13 attached between the locking member 11 and the engaging portion 111 of the locking member 11. In order to remove the surplus portions 12, 13, the manufacturers have to take time to cut the surplus portions 12, 13 by blades. However, this removing of the surplus portions 12, 13 is required certain skill so that a high price of the tool box is incurred. Furthermore, the operators cannot cut the surplus portions 12, 13 evenly because they use the blades with their hands so that the material of the tool box could be removed too much. In addition, when transporting the tool boxes, it is impossible to overlap the tool boxes because there has no suitable connecting device for securely connecting the overlapped tool boxes. Therefore, the manufacturers and the users are forced to carry two or more than two tool boxes separately.

The present invention intends to provide a locking device for a tool box wherein the locking device can connect two overlapped tool boxes together. The locking device of the present invention provides a new function so as to mitigate and/or obviate the shortcomings of the conventional locking device of the tool box.

SUMMARY OF THE INVENTION

In accordance with one aspect of the present invention, there is provided a tool box comprising a base portion having a first recess defined in the outside thereof and a first rib extending from the bottom of the first recess. A cover has a second recess in the upper surface and opens to the lateral surface of the cover. The second recess communicates with the first recess and a second rib extends from the bottom of the second recess. A locking member comprises a first part pivotally engaged with the first recess and has a second part pivotally connected to the first part. The second part is engagable with the second rib of the cover. When two tool boxes are overlapped the second part of the lower tool box is engaged with the first rib of the upper tool box.

The object of the locking device in accordance with the present invention allows the tool boxes overlapped to be secured together.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
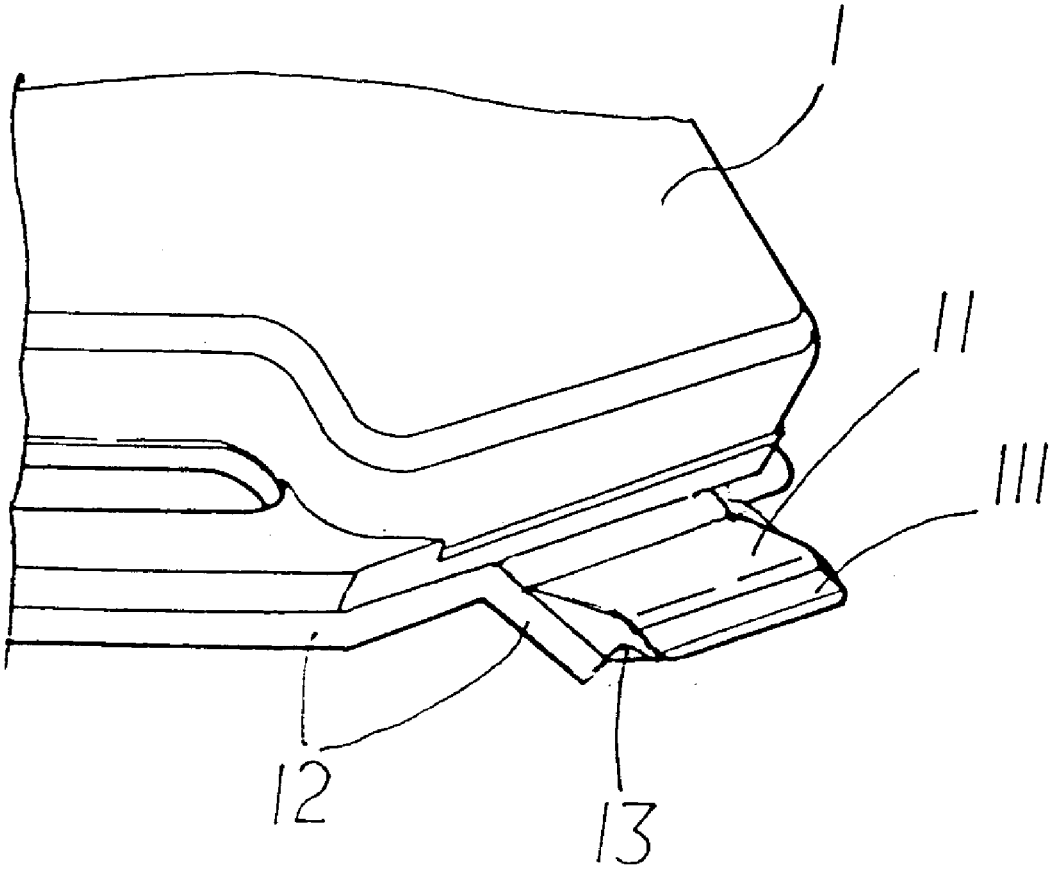
FIG. 1 PRIOR ART
FIG. 1 is a perspective view of the conventional locking device of a tool box.
Figure 2:
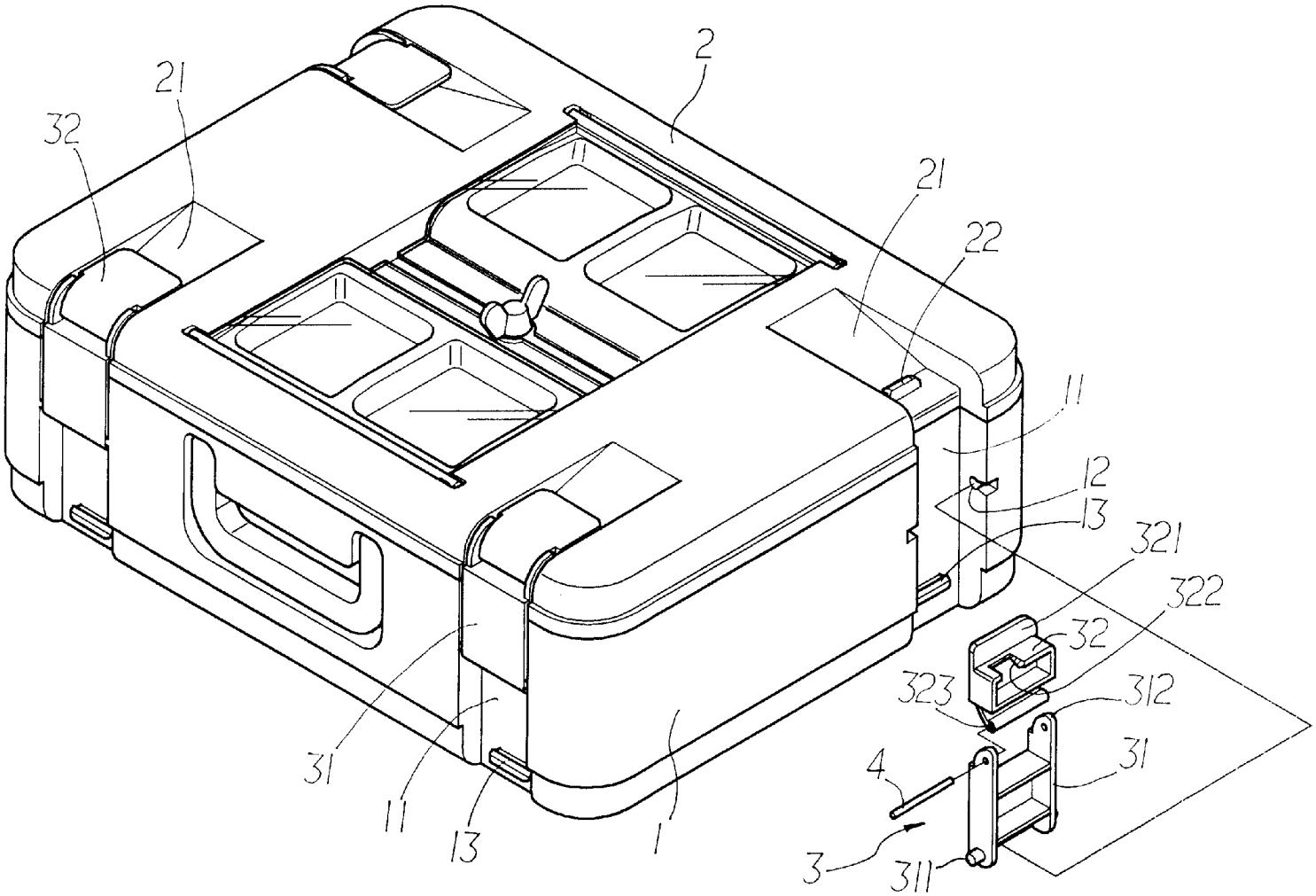
FIG. 2 is an exploded view of the first embodiment of the locking device in accordance with the present invention.
Figure 3:
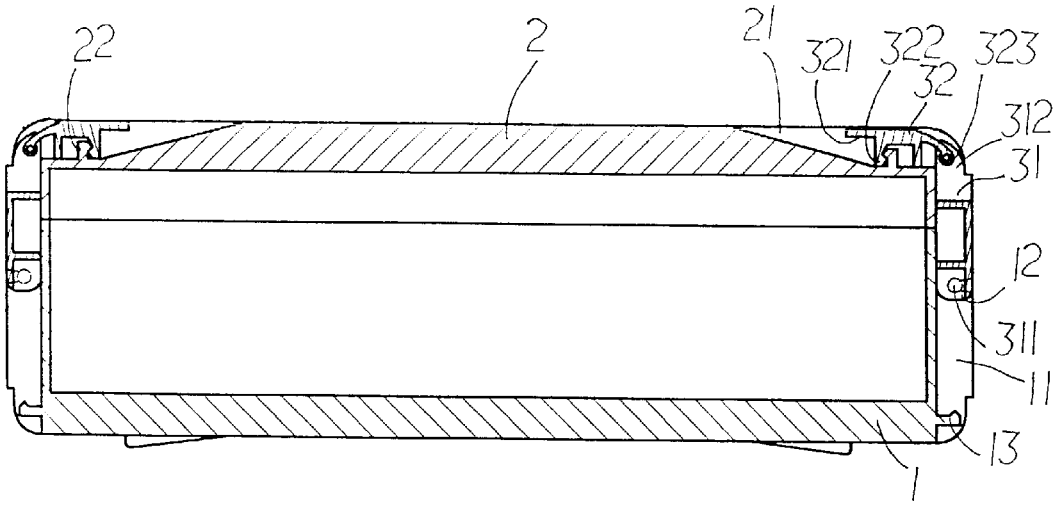
FIG. 3 is a side elevational view, partly in section, of the tool box with the locking device connecting the cover and the base portion.

Referring to FIGS. 2 and 3, the tool box comprises a base portion 1 having four first recesses 11 respectively defined in the front side and two lateral sides thereof, each of the first recesses 11 has a first rib 13 extending from the bottom thereof and located near the lower periphery of the base portion 1. The two sides of each of the first recesses 11 has two notches 12 defined therein.

A cover 2 has four second recesses 21 respectively defined in the upper surface and opening to the front side and two lateral sides of the cover 2. Each of the second recesses 21 are located to communicate with the first recess 11 corresponding thereto of the base portion 1. A second rib 22 extends from the bottom of each of the second recesses 21.

Four locking members 3 each comprise a first part 31 having two rods 311 extending from two sides thereof so as to be pivotally engaged with the notches 12 in the recess 11 corresponding thereto. Each of the first parts 31 has a second part 32 pivotally connected to two lugs 312 thereof by extending a pin 4 through the two lugs 312 and a tube 323 of the the second part 32. Each of the second parts 32 has a tubular portion which has a first engaging means 322 such as a protrusion extending from the inside thereof so as to be engaged with the second rib 22. Therefore, the second part 32 can be pivoted to engage the second rib 22 so as to secure the base portion 1 and the cover 2 together. A plate 312 extends from the tube of each of the second parts 32 so that the second part 32 is conveniently disengaged from the second rib 2.

Figure 4:
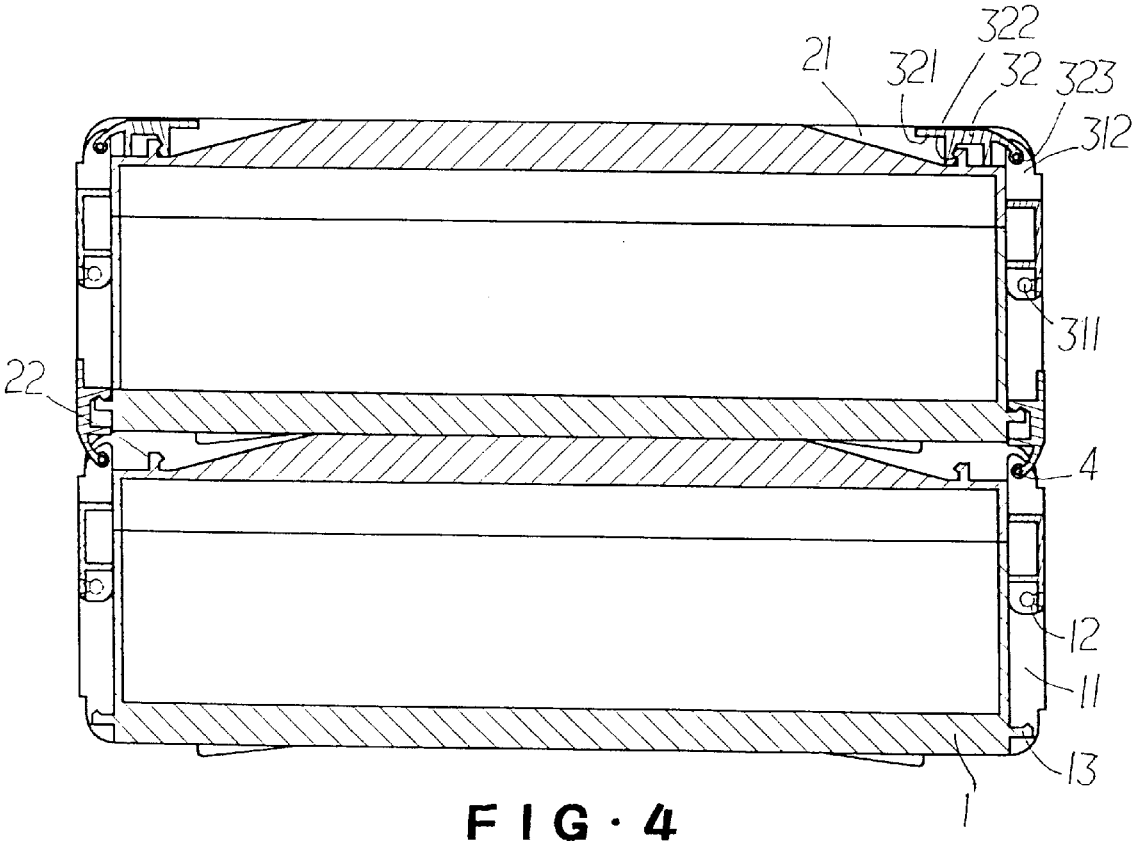
FIG. 4 is a side elevational view, partly in section, of two tool boxes overlapped and secured by the locking device in accordance with the present invention.

Referring to FIG. 4, when two or more than two tool boxes are overlapped, the second 32 of the lower tool box are disengaged from the respective second ribs 22 and engaged with the first ribs 13 of the upper tool box so that the overlapped tool boxes be securely overlapped.

Figure 5:
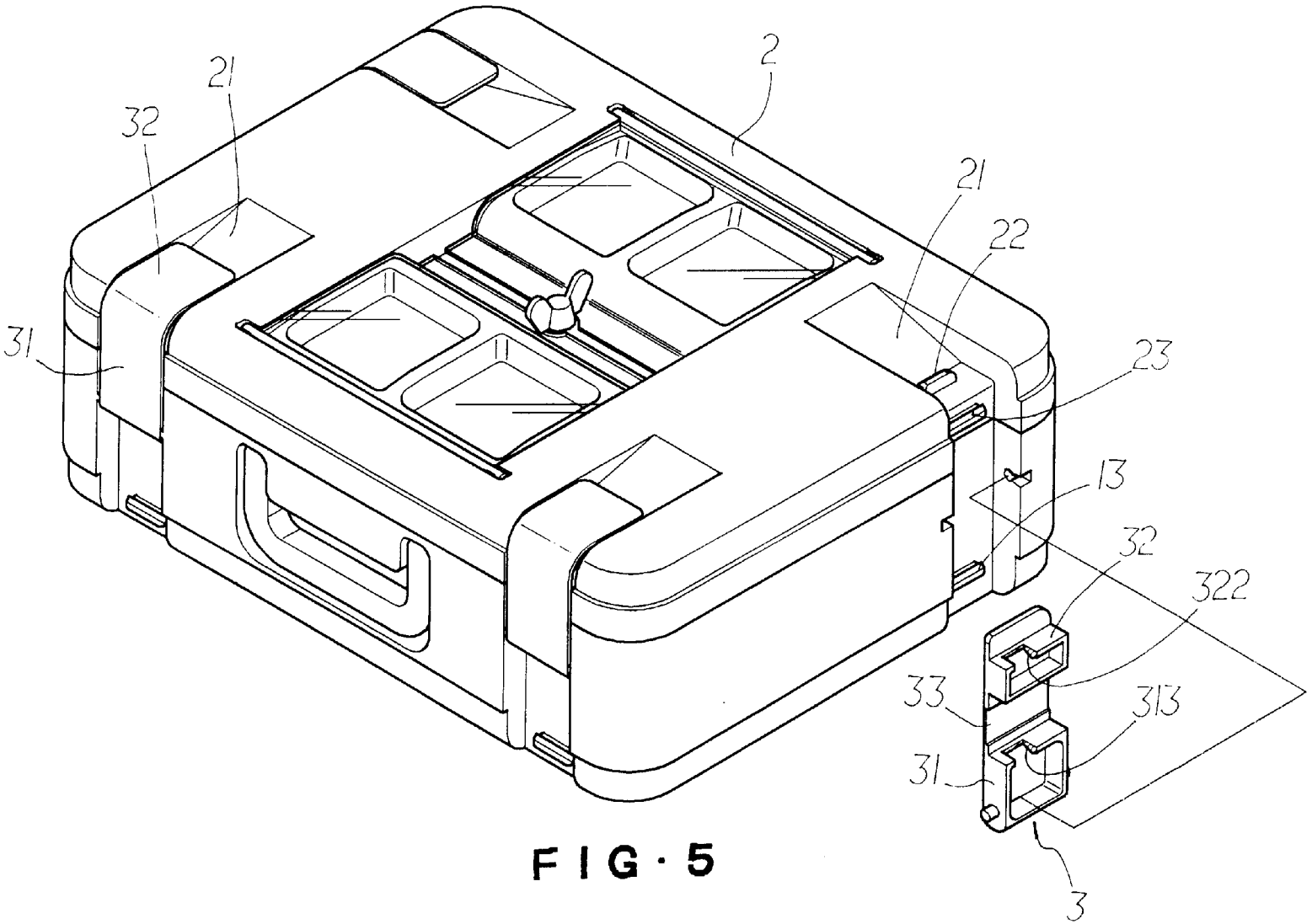
FIG. 5 is an exploded view of the second embodiment of the locking device in accordance with the present invention.
Figure 6:
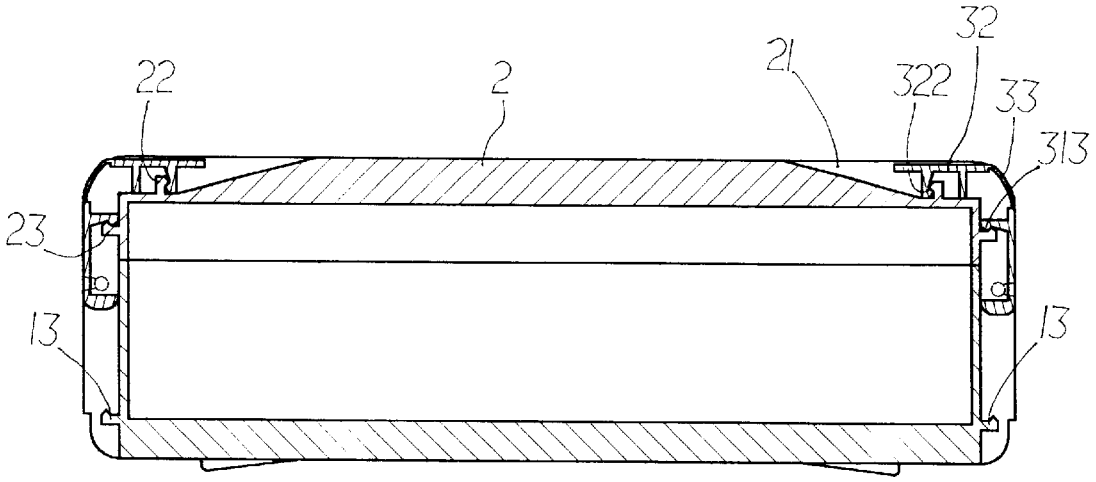
FIG. 6 is a side elevational view, partly in section, of the tool box with the locking device connecting the cover and the base portion.
Figure 7:
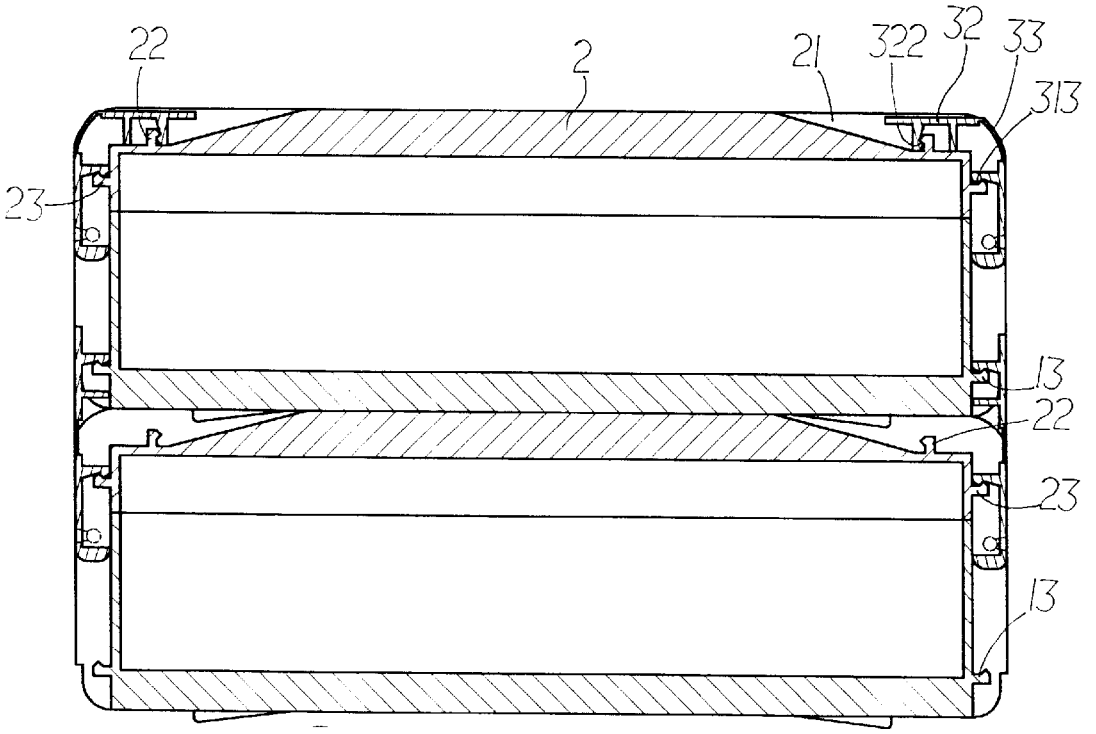
FIG. 7 is a side elevational view, partly in section, of two tool boxes overlapped and secured by the locking device in accordance with the present invention.

Referring to FIGS. 5 and 6, in the second embodiment of the present invention third rib 23 extends from the bottom of each of the second recess 21 in the lateral side of the cover 2. Each of the first parts 31 of the locking members 3 has a seconding means 313 for engaged with the third rib 23. The second engaging means 313 is connected to the first engaging means 322 by a flexible plate 33. Referring to FIG. 7, when two or more than two tool boxes are overlapped, the second parts 32 of the lower tool box are disengaged from the respective second ribs 22 and engaged with the first ribs 13 of the upper tool box so that the overlapped tool boxes can be securely overlapped. In the meanwhile, the second engaging means 33 are still engaged with the third ribs 23. By this way, the overlapped tool boxes can be firmly connected together.

The locking device has a compact size and the ribs 13, 22 and 23 are easily to be manufactured. By the locking device, the overlapped tool boxes are easily moved and carried.

While we have shown and described various embodiments in accordance with the present invention, it should be clear to those skilled in the art that further embodiments may be made without departing from the scope and spirit of the present invention.

What is claimed is:

1. A tool box comprising:

a base portion having an outside surface, having a first recess defined in said outside surface with said first recess having a bottom portion, and having a first rib extending from said bottom portion of said first recess;

a cover having an upper surface and a lateral side having a second recess defined in said upper surface, with said second recess having a bottom portion, with said second recess opening to said lateral side of said cover, with said second recess communicating with said first recess of said base portion, having a second rib extending from said bottom portion of said second recess;

a locking member comprising:

a first part pivotally engaged with said first recess; and a second part with said second part having an outside surface and an inside surface, with said second part pivotally connected to said first part, and with said second part having an engagement portion proportioned to be capable of engagement with said first rib of a second identical tool box, wherein said first recess has two sides and wherein said two sides of said first recess have notches defined therein and said first part of said locking member has two rods extending from two sides thereof so as to be received in said two notches.

2. The tool box as claimed in claim 1, wherein said second part has a tubular portion which has a first engaging means extending from the inside thereof so as to be engaged with said second rib.

3. The tool box as claimed in claim 1 further comprising a third rib extending from the bottom of said second recess in the lateral side of said cover, said first part of said locking member having a second engaging means for engaged with said third rib.

4. The tool box as claimed in claim 1 further comprising a plate extending from said second part.

* * * * *